US008709362B2

(12) United States Patent
Leventhal et al.

(10) Patent No.: US 8,709,362 B2
(45) Date of Patent: Apr. 29, 2014

(54) LABORATORY SPATULA

(75) Inventors: Margret Elaine Leventhal, Berkeley, CA (US); Heather Ann Koshinsky, El Cerrito, CA (US); Michael Steven Zwick, Vacaville, CA (US); Charles Robert Bupp, II, Lafayette, CA (US)

(73) Assignee: Investigen, Inc., Hercules, CA (US)

( * ) Notice: Subject to any disclaimer, the term of this patent is extended or adjusted under 35 U.S.C. 154(b) by 0 days.

(21) Appl. No.: 13/486,729

(22) Filed: Jun. 1, 2012

(65) Prior Publication Data

US 2012/0297902 A1 Nov. 29, 2012

Related U.S. Application Data

(63) Continuation of application No. 11/597,498, filed as application No. PCT/US2005/020246 on Jun. 7, 2005, now abandoned.

(60) Provisional application No. 60/578,074, filed on Jun. 7, 2004.

(51) Int. Cl.
*B01L 3/00* (2006.01)

(52) U.S. Cl.
USPC ..... 422/547; 422/560; 422/561

(58) Field of Classification Search
USPC ..... 422/401, 405, 411, 430, 547, 560, 561; 600/569, 570, 571, 572, 573; 604/1–3
See application file for complete search history.

(56) References Cited

U.S. PATENT DOCUMENTS

| | | | | |
|---|---|---|---|---|
| 285,054 | A | | 9/1883 | Moffitt |
| 674,446 | A | | 5/1901 | Marx |
| 1,490,785 | A | | 4/1924 | Purnell |
| 1,606,038 | A | | 11/1926 | Norman |
| 1,606,039 | A | | 11/1926 | Norman |
| 1,666,106 | A | | 4/1928 | Norman |
| 1,857,712 | A | | 5/1932 | Martini, Jr. |
| 2,859,515 | A | | 11/1958 | Kinman |
| 3,038,256 | A | | 6/1962 | Mayer |
| 3,525,339 | A | | 8/1970 | Halligan |
| 3,800,781 | A | * | 4/1974 | Zalucki ..... 600/562 |
| 3,828,765 | A | | 8/1974 | McDonald |
| 4,227,278 | A | * | 10/1980 | Raskin et al. ..... 15/234 |
| D259,533 | S | | 6/1981 | Frodsham |
| D290,328 | S | | 6/1987 | Imotani |

(Continued)

OTHER PUBLICATIONS

Slurpee Straw.

(Continued)

*Primary Examiner* — Jill Warden
*Assistant Examiner* — Dwayne K Handy
(74) *Attorney, Agent, or Firm* — Brinks Gilson & Lione

(57) ABSTRACT

Laboratory spatula having stalk regions with a hollow first end and a hollow second end and at manipulating regions may be used for collecting, transporting or storing a material. A manipulating region may be configured as a shovel region, a scoop region, a whisk region, a punch region, a sieve region, a loop region, a cutting edge, a spreading region, a grinding region, a hook region, a scraper region, a tweezer region, a grasper region, or a pick region. The spatula may be light-weight and disposable, and may be any appropriate size including micro size, a regular size, or a macro size. The spatula may also have an anti-stick surface. The spatula may be calibrated, and may include calibration marks or additional features.

17 Claims, 9 Drawing Sheets

(56) References Cited

U.S. PATENT DOCUMENTS

| | | | | | |
|---|---|---|---|---|---|
| 4,735,905 | A | * | 4/1988 | Parker | 436/174 |
| 4,768,819 | A | | 9/1988 | Tarlow et al. | |
| 4,842,132 | A | * | 6/1989 | Wells | 206/229 |
| 4,863,174 | A | * | 9/1989 | Cummings | 473/509 |
| D316,503 | S | | 4/1991 | O'Grady | |
| 5,038,476 | A | | 8/1991 | McCrea | |
| 5,114,074 | A | * | 5/1992 | Frauenthal et al. | 239/33 |
| D330,481 | S | | 10/1992 | Green | |
| 5,163,441 | A | * | 11/1992 | Monthony et al. | 600/572 |
| 5,195,507 | A | | 3/1993 | Bilweis | |
| D370,587 | S | | 6/1996 | Lynch | |
| 5,678,450 | A | | 10/1997 | Robbins et al. | |
| 5,718,681 | A | * | 2/1998 | Manning | 604/518 |
| 5,727,321 | A | | 3/1998 | Lewis | |
| 5,946,807 | A | | 9/1999 | Crane | |
| 5,993,560 | A | * | 11/1999 | Wasak et al. | 134/6 |
| 6,171,259 | B1 | * | 1/2001 | Fisher | 600/549 |
| D440,810 | S | | 4/2001 | Olson | |
| 6,247,736 | B1 | | 6/2001 | Esterson et al. | |
| D458,809 | S | | 6/2002 | Richardson et al. | |
| 6,463,662 | B1 | | 10/2002 | Coscia | |
| 7,047,648 | B1 | | 5/2006 | Lebel | |
| 2004/0237311 | A1 | | 12/2004 | Brown et al. | |
| 2006/0230561 | A1 | * | 10/2006 | Sampaio | 15/106 |

OTHER PUBLICATIONS

Baskin 31 Robbins Straw.

* cited by examiner

LABORATORY SPATULA

CROSS-REFERENCE TO RELATED APPLICATIONS

This application is a continuation of U.S. Patent Application Serial No. 11/597,498, filed Nov. 22, 2006 now abandoned, which is a §371 filing based on PCT/US2005/20246, filed Jun. 7, 2005, and claims priority to the U.S. Provisional Patent Application No. 60/578,074, titled "LABORATORY SPATULA" and filed on Jun. 7, 2004, the entire contents of which are herein incorporated by reference in their entirety.

BACKGROUND

1. Field

The present application relates to spatulas, particularly multifunctional laboratory spatulas.

2. Related Art

Laboratory spatulas are often used to dispense chemicals or biological samples, or to collect a quantity of material for measurement or analysis. Many prior art laboratory spatulas are elongated metal spatulas (e.g., stainless steel) that can be re-used after washing and/or sterilization. It is common laboratory practice to use such re-usable spatulas with disposable weigh boats or other disposable containers. Thus, a fresh spatula must be used with each material to prevent cross-contamination, and used spatulas must be cleaned.

Furthermore, many spatulas have only a single blade for dispensing material. Most metal spatulas are heavy, and therefore more difficult to manipulate. Metal spatulas may also have large handles that make manipulation of the spatula difficult. Metal spatulas are also not flexible, and can be further limited in their uses because the metal may conduct temperature and electrical current. For example, it could be difficult to handle a metal spatula when working with extremely cold or extremely hot preparations.

To avoid these problems, some researches have turned to inadequate substitutes for metal spatulas. For example, wooden or plastic tongue-depressor type devices can be used to transfer chemicals. However, these flattened elongated shapes are badly suited to transferring materials, particularly small amounts of material, or material in containers that have openings that are difficult to access. For example, these types of spatulas tend to be very thick, are also difficult to grasp, and may not have chemical or physical properties that are compatible with laboratory use.

Finally, most laboratory spatulas can hold only a limited amount of material. For example, only the ends of most prior art laboratory spatulas can be used to hold granular chemicals. Further, there is a risk of spilling material when using these prior art spatulas, because the material only resets on the blade of the spatula, on an open surface. In addition, most laboratory spatulas can only be used with solids (e.g., granular solids or powders), and cannot safely be used to store material for any length of time.

SUMMARY

Described herein are disposable, hollow laboratory spatulas for manipulating (e.g., collecting, transporting, storing, etc.) a material such as a laboratory chemical or biological sample or a sample of an unknown material; kits including laboratory spatulas; and methods of using laboratory spatulas. As described in more detail below, a laboratory spatula may be completely or partially hollow, and both ends of the spatula may be configured to hold or transfer one or more materials. A laboratory spatula may be calibrated. In some variations, the laboratory spatulas are pretreated (e.g., coated, infused, or embedded, etc.) in order to have a desirable property (e.g., anti-friction, anti-static, hydrophobicity, etc.). In some variations, the laboratory spatulas are textured.

In one exemplary embodiment, a spatula includes a stalk region having a hollow first end and a hollow second end, a first manipulating region at the hollow first end of the stalk region, and a second manipulating region at the hollow second end of the stalk region. The first manipulating region and the second manipulating region may be any appropriate type of manipulating region. In general, a manipulating region may be any region having an extended open surface for collecting or contacting a sample. The manipulating region may be selected from the group including (but not limited to): a shovel region, a scoop region, a whisk region, a punch region, a sieve region, a loop region, a cutting edge, a spreading region, a grinding region, a hook region, a scraper region, a tweezer region, a grasping region or a pick region. Of course, although the manipulating regions described herein may be referred to as "shovel region" or "scraper region" or the like, it is to be understood that all of these regions may have multiple, and overlapping functions. For example, a shovel region may be used to shovel, scrape, stir, cut, pick, or the like. Thus a single spatula may have multiple uses, particularly if the spatula has manipulating regions at both ends, further increasing the possible uses of the spatula.

In some variations, at least one end of the spatula is closed, and may be sealed (closing off a hollow interior region). As used herein, unless the context specifies otherwise, the term "hollow end" refers to a hollow end region, and may include hollow end regions that are open or closed. For example, a first hollow end may be closed (or sealed) off. Although the very end of the region is closed, the end region may remain hollow. The spatula may also include calibration marks for measuring a quantity of material held by the spatula. The calibration marks may be on any appropriate part of the spatula, including the stalk and the manipulating region. In some variations, the entire spatula is hollow.

The spatula, or any part of the spatula, may be made of any appropriate material, including polypropylene. In some variations, the spatula also includes an anti-static agent or material, such as fatty acid esters, ethoxylated amines, quaternary ammonium compounds, alkylsulfonates, and alkylphosphates which are sold under a variety of brand names such as Atmer™ AS 290G, Baerostat 318 S, Irgastat® P 18 (CIBA Specialty Chemicals, Switzerland), Irgastat® P 22 (CIBA Specialty Chemicals, Switzerland), Lankrostat 0-600 (Akcros Chemicals, United Kingdom), CESA®-stat PPA-TEE 17690 (Clariant, Winchester Va.), ALA Ethylan L-3, Ampacet 100323 (Amapcet, Tarrytown, N.Y.), Larostat 264 A anhydrous (BASF Corporation, Mount Olive, N.J.), Plasadd PE8811 (Cabot Corp., Boston Mass.), Chemstat 106G-60DC, Masterad Antistatic AD-100L, Dehydat 10 PE 40 (Polycom Huntsman, St. Claire, Mich.), 0129-12, Niax® Antistat AT-21, Kemamide® W-40 (Crompton, Middlebury Conn.), Tegomer® 994 S, Aluminasol 100, Zelec Electroconductive Powder and Bayton. In particular, the material Nourymix® AP 675 (Armostat® 600 in a PP carrier) or Nourymix® AP 475 (Armostat® 400 in a PP carrier) (Akzo Nobel Polymer Chemicals BV, Amersfoort, The Netherlands) may be particularly useful. For example, the micro spatula's described above may incorporate Nourymix® AP 675 (Armostat® 600 in a PP carrier) or Nourymix® AP 475 (Armostat® 400 in a PP carrier). Furthermore, the spatula may be any appropriate size or length. For example, a spatula may be a micro spatula, having a length of less than about 195 mm (or between about 15 mm and 195 mm long). A spatula may be a standard spatula (e.g., between about 195 mm to 220 mm long). A spatula may be a macro spatula having a length of greater than about 220 mm (e.g., between about 220 and 400 mm long).

Also described herein are spatulas comprising a stalk region having a hollow first end and a hollow second end, and a manipulating region at the hollow first end of the stalk region. The manipulating region can be selected from the group consisting of: a whisk region, a punch region, a sieve region, a loop region, a cutting edge, a spreading region, a grinding region, a hook region, a scraper region, a tweezer region, a grasping region or a pick region. In some variations, the spatula may have only one manipulation region (and may be open at the other end, or closed at the other end).

Also described herein are spatulas for manipulating a material, comprising a stalk region having a hollow first end and a hollow second end, and a manipulating region at the hollow first end of the stalk region. Manipulating may include collecting, transporting, stirring, storing, or the like. The spatula may also be greater than 400 mm long, and the stalk region may have a wall thickness that is less than about 0.1 mm thick. Any appropriate manipulating region may be used.

Also described herein are methods of using a laboratory spatula including contacting a laboratory chemical with a laboratory spatula comprising a stalk region having a hollow first end and a hollow second end; and a manipulating region at the hollow first end of the stalk region. The laboratory spatula may manipulate the laboratory chemical (or biological sample) with the first manipulating region. For example, the laboratory spatula may manipulate the chemical by collecting, stirring, moving, storing, etc. The method may further include disposing of the laboratory spatula.

BRIEF DESCRIPTION OF DRAWINGS

The present application can be best understood by reference to the following description taken in conjunction with the accompanying figures, in which like parts can be referred to by like numerals.

DETAILED DESCRIPTION OF EXEMPLARY EMBODIMENT(S)

In general, a laboratory spatula may be a disposable laboratory spatula comprising a stalk region connected to one or more manipulating regions for collecting, transferring, measuring or storing material such as chemicals (e.g., laboratory chemicals), solutions or the like. The laboratory spatula may include a connecting junction (e.g., a neck) between the stalk region and a manipulating region. The laboratory spatula may also be at least partially hollow, so that the manipulating regions are adjacent to openings into the stalk region.

Figure 1A:
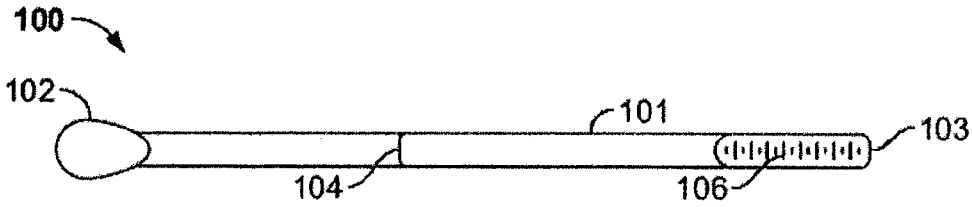
FIG. 1A is a top view of a representative two-ended spatula.
Figure 1B:
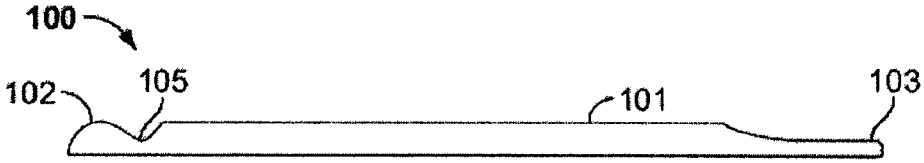
FIG. 1B is a side view of the spatula of FIG. 1A.
Figure 1C:
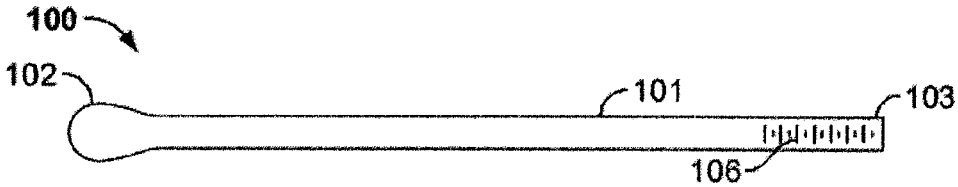
FIG. 1C is a bottom view of the spatula of FIG. 1A.

FIGS. 1A to 1C show an example of a spatula 100 configured such that a user can hold the spatula 100 to use a first manipulating region (shown here as a shovel region 102) or a second manipulating region (shown here as a scoop region 103). The spatula includes a stalk region 101 having a hollow first end and a hollow second end that allows the spatula 100 to be used to place quantities of gases, liquids or solids inside the stalk portion. The stalk region 101 may be completely hollow.

Various regions (e.g., the stalk region, manipulating regions, etc.), characteristics, and properties of laboratory spatulas are described below. Although this description is broken up into sections, it should be understood that the laboratory spatulas described herein may include any reasonable combination or variation of the properties and characteristics described in each of the sections. Furthermore, any region of a laboratory spatula may incorporate characteristics described for any other region.

Stalk Region

The stalk region (which may also be referred to as a stalk segment) may be any appropriate length, diameter, and shape so that it can be grasped to manipulate one or more of the manipulating regions of the spatula. The stalk region is generally an elongated shape having at least two ends, onto which manipulating regions may be connected. The stalk region is also at least partially hollow, and in some variations, the stalk region comprises a handle region that can be gripped by a user. The stalk region may comprise one or more inner chambers formed within the hollow core of the stalk region. In some variations, the stalk region comprises markings, including calibration markings.

a. Shape of the Stalk Region

The stalk region may comprise any appropriate shape that can be grasped by a user and that can connect to one or more manipulating regions. Thus, the stalk region may be linear, curved, rounded, elongated, asymmetric, or tapered. In some variations, the stalk region may be flexible, or bendable. For example, the stalk region may include a hinged region, an accordion region, or a deformable region.

The stalk region may have any appropriate cross-section, or different cross-sections. For example, the stalk region may include a cross-section that is polygonal (e.g., triangular, rectangular, pentagonal, etc.), circular, elliptical, or asymmetric. In some variations, the stalk region includes areas having different cross-sectional shapes, or combinations of cross-sectional shapes. The cross-section may be hollow (e.g., when that portion of the stalk region is hollow).

In some variations, the stalk region is completely or partially hollow. For example, the stalk region may have an inner cavity (e.g., a tube) that extends the entire length of the stalk region. The cavity formed within the stalk region may open at one or both ends of the stalk region so that the cavity can be filled with a material being transported or measured by the spatula. In some variations, the stalk region includes one or more openings into the cavity from the sides of the stalk region.

The walls of the stalk region may have a wall thickness that is uniform over the length of the stalk region, or the stalk region may have a wall thickness that is thicker or thinner in some regions than in others (e.g., along the length, across the width, or both). The wall thickness may be related to the size of the spatula, the shape of the spatula, or the length of the stalk region. In some variations, the stalk region is hollow, but includes one or more "plugs" or seals blocking all or part of the cavity formed within the spatula. A plug may block a material that is being transferred, measured or stored by the spatula from entering another part of the spatula stalk or from spilling out of the spatula (e.g., when material is stored in the stalk region). A plug may be formed from the walls of the spatula (e.g., by melting), or from another region of the spatula.

The stalk region may include a handle region adapted so that it can be readily grasped or held by a users' hand, or by some additional device. In some variations, the handle region is textured to facilitate gripping the spatula. Any appropriate texture may be used, including pebbled, indented, woven, ventilated, grooved, roughened, smoothed, ribbed, etc. The handle region may also have a different cross-section than other portions of the stalk region. For example, the handle region may comprise an enlarged cross-section, a flattened cross-section, rounded cross-section, etc. In some variations, the entire stalk region is a handle region.

The stalk region may comprise any appropriate size. In some variations, the stalk region is greater than 5× longer than it is wide. In some variations, the ratio of length to width of the stalk region is greater than 10×, 20×, 30×, 50×, or 100×. The width may change as the length changes. For example, the stalk region may taper at one or both ends. In some variations, the length of the stalk is not related to the width of the stalk. In some variations, the stalk section may be extendable (e.g., may become longer or shorter). For example, the stalk section may be telescoping, or may extend/contract by an accordion structure.

Figure 1D:
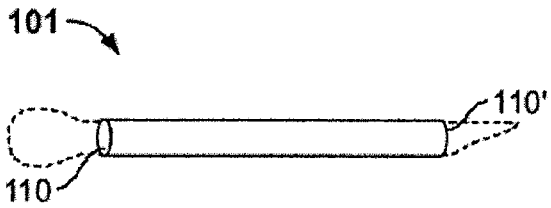
FIGS. 1D to 1J show top views of stalk regions that may be part of a laboratory spatula as described herein.

FIGS. 1D-1J show different variations of stalk regions that may be part of a laboratory spatula as described herein. Although manipulating regions are also shown, they are only indicated by dashed lines, to emphasize the stalk regions. In FIG. 1D, the stalk region comprises a hollow cylinder. This cylindrical stalk region has two terminal ends 110, 110' that open into a central passageway in the stalk region. In some variations, manipulating regions are attached to these ends of the stalk region, either directly or through a connection junction, as described further below.

Figure 1E:
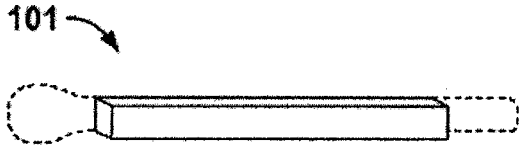

FIG. 1E shows a stalk region 101 having a rectangular cross-section. As described above, the stalk region may have any appropriate cross-sectional profile, including polygonal profiles. In FIG. 1E, the stalk region comprises four walls that enclose a hollow core. Flat sides or areas on a stalk region (as shown in FIG. 1E) may help store the spatula (e.g., allowing stacking, packaging, etc.), or may help a user handle the spatula. For example, a spatula with one or more flat sides can rest on a flat surface when it is set down on a flat side.

Figure 1F:
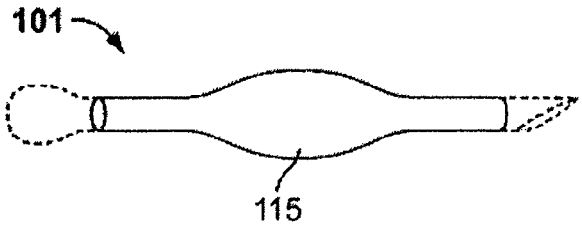

FIG. 1F shows a stalk region 115 having a "bulb" or enlarged portion. This bulb 115 may be hollow, and may be sealed off at one end so that the bulb can be used to draw material (e.g., fluid) into one end of the spatula and be held or stored therein. In some variations, the spatula may include pre-loaded materials (e.g., solutions, chemicals, etc.). For example, material may be preloaded into the stalk region (even in variations without a bulb) and sealed or closed within the stalk region. Thus, a bulb 115 portion of a spatula may be used to store pre-loaded material that can be released later. In some variations, the interior (e.g., hollow portion) of the spatula may be used for mixing. For example, the bulb 115 portion may be used to mix material inside of the spatula, including mixing samples collected by the spatula with material that has been pre-loaded into the bulb. In one variation, material can be released from the hollow portion of the stalk region by squeezing the stalk region (e.g., the bulb) to apply pressure. A portion of the stalk (e.g., a seal between the hollow portion and the end) may comprise a frangible material, or may be otherwise opened or disrupted to release material held within the spatula. In some variations, material can be released from a hollow portion of the spatula because a portion of the stalk (e.g., a seal) is disrupted by contact with a material drawn into the stalk (e.g., water), or by temperature or energy applied to the stalk region (e.g., by melting a wax seal, etc.).

The stalk region may also include a handle region for gripping or manipulating the laboratory spatula. In FIG. 1F the wide central region 115 of the stalk can be a handle or a grip region, as described above. In some variations, this handle region is flattened (not shown), and can give the handle an orientation (e.g., up/down, top/bottom) that may also help in manipulating the spatula. The handle region can include any additional modification to enhance gripping the stalk region and therefore handling the laboratory spatula. Another example of a handle region is shown in FIG. 1G.

Figure 1G:
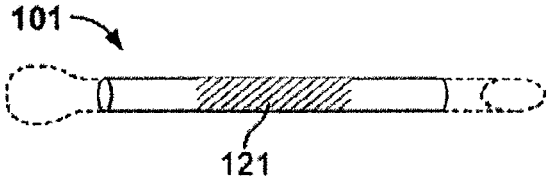

In FIG. 1G, the stalk region 101 includes a handle region 121 that has been textured to provide a more secure gripping surface. In some variations, this textured surface comprises ridges that run along the sides of at least a portion of the stalk region, as shown. The handle region may help control the spatula (e.g., preventing slipping, etc.) and may also provide support for the spatula. In some variations, the texture (e.g., ridges, dimples, etc.) also enhances the structural strength of the spatula. For example, the ridges 121 shown in FIG. 1G may act as ribs or support beams providing structural support to the spatula (and particularly to the stalk region). The texture of the handle region may also provide a visual indication of where to grip the spatula. The handle may also be otherwise marked (e.g., by a color or other label).

Figure 1H:
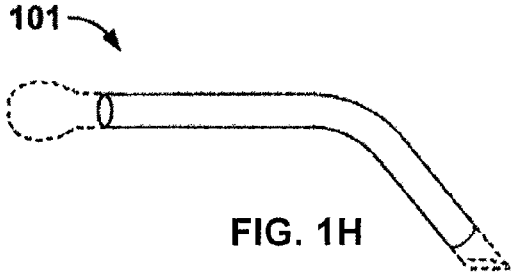

Although many of the stalk regions described herein are shown as elongated (linear), shapes, the stalk region may comprise any appropriate shape, including non-linear (e.g., rounded, angled, curved, bent, spherical, etc.) shapes. FIG. 1H shows one example of a bent stalk region. Spatulas having curved or bent stalk regions may be particularly useful in spaces that would be inaccessible to straight spatulas. The stalk region may be bent or curved to any degree (e.g., 10°, 30°, 45°, 90°, 180°, etc.). In FIG. 1H, the stalk region is shown with an approximately 45° angle bend. In some variations, the stalk region is bendable. For example, the stalk region may include a flexible region (e.g., an accordion-like region, or a region comprising a joint or hinge). A bent stalk region may allow for more ergonomic handling of the spatula. As described further below, the spatula may also comprise a curve or bend (or bendable region) as part of a manipulating region, or as part of a connecting junction.

Figure 1I:
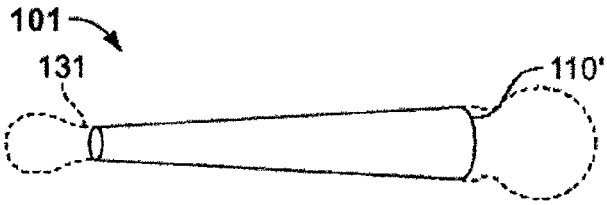

FIG. 1I shows a stalk region with a tapered end 131, so that one of the openings 110' into the hollow portion of the spatula is larger than the opposite end 131. A tapered or spiral shape may add additional structural strength to the stalk region of the spatula (e.g., in a direction along the long axis of the spatula), or may allow the spatula to act as a funnel. As described herein, the spatula may be used as a funnel even in variations in which the stalk region is not tapered.

b. Marking the Stalk Region

The stalk region may comprise any appropriate marking, color, or labels. For example, the stalk region may be calibrated. Calibration may indicate depth (e.g., distance from one end of the spatula or the other), volume (e.g., fill volume within a cavity of the stalk region), mass (e.g., estimated from volume, etc.) or any other appropriate parameter (e.g., temperature, pH, etc.). Calibration may comprise one or more calibration marks that may be located in any appropriate position on the stalk region or spatula. The calibration marks may include major and minor marks, and may include labels, units, or other identifying features.

Figure 1J:
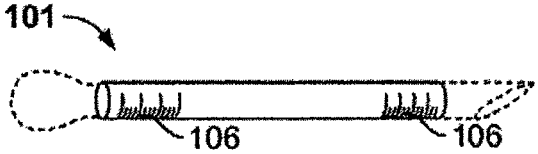

FIG. 1J shows a stalk region for a spatula that includes calibration markings 106 at either end. These calibration marks are shown extending partially around the diameter of the stalk region 101. Calibration marks may be on any appropriate part of the spatula, including the stalk region a manipulating region, a connecting junction, or a combination of these parts. In some variations, the entire spatula (or the entire stalk region) is calibrated. For example, a material could be measured into the cavity of the stalk region, and the stalk region (or the spatula) could be closed off so that the material may be stored within the spatula for later use.

The stalk region may be marked with any sort of identifying information (e.g., numerical information, date of manufacture, type of spatula, manufacturers name, etc.). In some variations, the stalk region comprises a labeling region that may be marked. For example, the stalk region may comprise a labeling region that readily accepts ink, adhesive label, or other markings. In some variations, the labeling region is configured so as not to interfere with other regions of the spatula, such as any calibration marks, handle, etc. In some variations, the labeling region comprises a coating, texture, or incorporated material to enhance labeling. The labeling region may be specifically indicated on the spatula (e.g., by a visual cue, such as a box, a phrase or word, etc.).

As mentioned, a spatula can be made from the combination of any of the stalk regions described herein and any one or more manipulating regions.

Manipulating Region the spatula may comprise one or more manipulating regions that are attached to the ends 110, 110' of a stalk region 101 so that the spatula may be used to collect, carry, or store a material. Any appropriate material may be manipulated (e.g., collected, carried, stored, etc.) by the spatula through a manipulating region, including solids, liquids, gases, suspensions, gels, mixtures, samples, etc. In general, a manipulating region includes one or more extended open surfaces that interact with a material. Manipulating regions may allow the spatula to collect, carry or store materials. The manipulating region may comprise a shovel region, a scoop region, a whisk region, a punch region, a Sieve region, a loop region, a cutting edge, a spreading region, a grinding region, a hook region, a scraper region, a tweezer region, a grasping region, a pick region, or the like. In some variations, the manipulating region may be formed from the same material as the stalk region. For example, a manipulating region may be cut, shaped, extruded, or formed from the same material as the stalk region. The extended open surface (or surfaces) of the manipulating region may be different from the walls of the stalk region. The stalk region typically includes a hollow region that is not part of the manipulating region, to which the manipulating region is connected. The stalk region may also be separated from a manipulating region by a connection junction.

In some variations, a single manipulating region is attached to one of the ends of a stalk region. In other variations, both ends of a stalk region have manipulating regions. The two manipulating regions attached at each end of a stalk region may be identical manipulating regions, or they may be different. For example, a first manipulating region may comprise a shovel-type manipulating region, and a second manipulating region may comprise a scoop-type manipulating region. The manipulating region may be connected to the stalk region in any appropriate manner and orientation. For example, two manipulating regions may be attached to a stalk region so that they lie in the same plane as the stalk region. In one variation, the manipulating regions attach to the stalk region so that they lie in different planes relative to each other.

Any of the manipulating regions described herein may be calibrated, or may include calibration marks, as described above for calibration of the stalk region. Thus, the manipulating region may comprise calibration marks arranged to allow measurement or estimation of quantities of a solid or liquid. In some variations, the calibration marks may encompass a range of values, and may be of any appropriate value. In some variations, the spatula (or regions of the spatula) is calibrated or configured to collect, hold or transfer a predetermined amount of a substance. For example, the manipulating region may be configured to hold a predetermined volume (ml, cubic inches, cubic meters, ounces, teaspoons, grams, etc.). Calibrated spatulas do not need to include calibration marks.

a. Shapes of Manipulating Regions

FIGS. 2A-2N and 2P-2Y show different manipulating regions as described herein. The manipulating regions shown in these figures illustrate some of the different shapes of manipulating regions of the laboratory spatula. Variations of any of these types of manipulating regions are also intended to be included as manipulating regions. For example, the size (e.g., length and width), curvature, texture, edge (e.g., sharpness, serration, bluntness, smoothness, etc.), color, thickness, and position (i.e., relative to the stalk region) of any of these manipulating regions may all be changed. Further, any of the manipulating regions shown or described herein may be used with any of the stalk regions described herein.

Figure 2A:
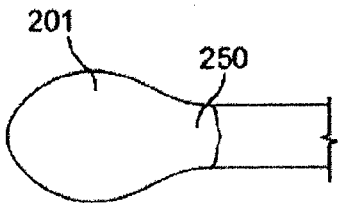
FIGS. 2A to 2N show top views of manipulating regions that may be part of a laboratory spatula as described herein.

FIG. 2A shows a shovel type of manipulating region that may be part of a laboratory spatula. The shovel region comprises an inner surface 201 and an outer surface (not shown). The inner surface may be continuous with the inside of the stalk region (e.g., with a wall forming the hollow core of the stalk region), and the outer surface may be continuous with the outer surface of the stalk region. Either the inner 201 or outer surface of the manipulating region may be used to collect, transport or store a substance. For example, the shovel-type manipulating region can readily be used to scoop up a granulated or powdered substance on the inner surface. The substance collected in this way could be transported by moving the spatula. In some variations, the substance may be transferred into the hollow area of the stalk region connected to the shovel region. For example, the spatula may be tipped so that material held in the shovel region moves into the hollow area of the stalk region.

Figure 2B:
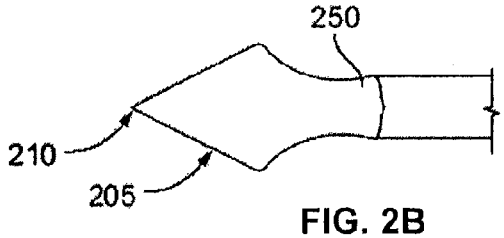
FIGS. 2P to 2Y show additional top views of manipulating regions that may be part of a laboratory spatula as described herein.
Figure 2C:
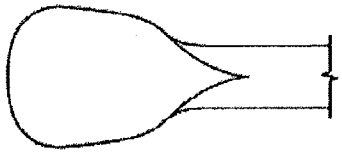
Figure 2D:
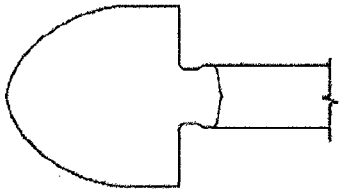

The shovel region shown in FIG. 2A is oval in shape, with curving edges forming the inner and outer surface. However, the manipulating region may have any appropriate shape. Examples of other shovel-type manipulating regions are shown in FIGS. 2B to 2D. The shovel region (shovel-type manipulating region) may also be referred to as a spoon region. In FIG. 2B, the shovel region includes a pointed tip and two relatively straight sides, providing a triangular shape. In some variations the manipulating region is rigid, or made from a stiff material. The pointed tip and straight sides may allow the spatula to cut, scrape, pierce, or impale a material. In some variations, one or more of the edges of a manipulating region may be sharp. For example the long edge 205 shown in FIG. 2B may be sharpened so that it can be used to cut or slice materials. A point or tip 210 on a manipulating region may also be sharp. In general, a shovel region (like any of the manipulating regions) may have multiple uses. For example, the shovel region may be used to shovel material, or to scrape (e.g., by using the edge of the shovel region, or by inverting the shovel region), to pick, etc.

FIG. 2C shows another example of a shovel region. The surface area of the shovel region (e.g., the inner surface area) can be maximized to allow collecting, transfer or storage of a larger amount of material. Thus, in FIG. 2C, the larger surface area corresponds to the broad tip of the manipulating region. FIG. 2D shows another variation of a shovel region in which the tip is somewhat pointed (though it is not shown as sharp as the tip 210 in FIG. 2B). Differently shaped shovel surfaces may allow the manipulating region to remove and collect different amounts or types of material with the spatula. FIG. 3, described further below, illustrates different curvatures that may be used with the shovel region. For example, the inner surface of the shovel region may include concavities for collecting or holding material (including liquid materials). In some variations, a concavity in the inner surface of a manipulating region is continuous with the hollow portion of the stalk region, so that material can be stored in the hollow without spilling the material.

Figure 2E:
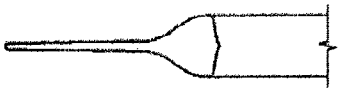
Figure 2F:
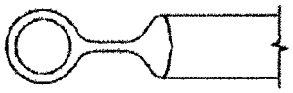

FIG. 2E shows a manipulating region that is configured as a pick. In FIG. 2E, the pick region is a long, narrow member that terminates in a tip. This tip may be sharp or blunt. A spatula having a pick region may be useful for selecting or picking small materials, e.g., picking colonies (bacterial, yeast, etc.) or for jabbing or pointing to a material, or for access to small or hard to reach spaces. In some variations, the manipulating region may comprise more than one pick. The inner and/or outer surface of the manipulating region may also be configured as a loop (e.g., having an opening), as shown in FIG. 2F. A manipulating region configured as a loop may be used, for example, to spread colonies of bacteria on a solid medium.

Figure 2G:
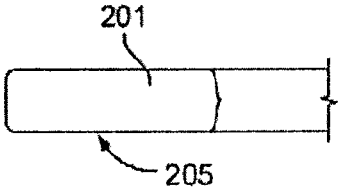
Figure 2H:
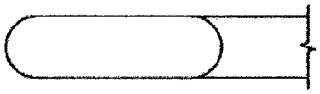
Figure 2I:
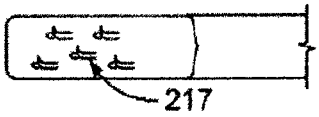
Figure 2J:
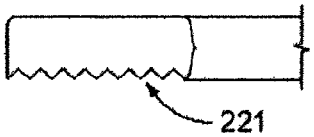
Figure 2K:
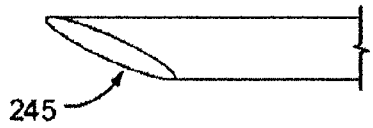

The manipulating region may also be configured as a scoop, as shown in FIGS. 2G, 2H and 2K. A scoop is generally narrower or the same width as the stalk region 101. For example, in the scoop shown in FIG. 2G, the inner 201 and outer surface of the scoop are the same width as the stalk region (typically, the width of the shovel region exceeds the width of the stalk region). As previously described, the edges of the manipulating region may be pointed, curved or sharpened. FIG. 2H shows a variation of a scoop region in which the edges have been rounded. In some variations, the scoop region provides a long, relatively straight edge 205 that may be useful for collecting material with the spatula. The scoop may be flat or curved.

Any of the manipulating regions described herein may be adapted in any appropriate manner. For example, FIG. 2I shows a scoop-type manipulating region that has scrapers 217 that may be used to scrape or tear tissue. Scraping surfaces 217 may be formed from the surface of the manipulating region (e.g., by cutting, punching, etc.) and may be sharp or pointed, and bent so that they can be scraped against a surface. For example, scraping surfaces may be hanging chads. In some variations additional surfaces (e.g., the scraping surfaces shown) may be attached to the manipulating region. For example, portions of the manipulating region may be attached (e.g., glued, epoxied, soldered, welded, fused, melted, etc.) onto other portions of the manipulating region.

FIG. 2J shows another example of a manipulating region comprising an edge surface 221 that is serrated. This scoop-type manipulating region may be used to cut, scrape, abrade or score a material. In some variations, the serrations are sharpened.

The manipulating region may also be a beveled, region, having an exposed or open surface onto which a material may be collected or held. For example, FIG. 2K shows an example of a scoop-type manipulating region that comprises a bevel 245 that comes to a point. The bevel may be any appropriate angular cut (e.g., the angle of the bevel 245 may be 15°, 30°, 45°, 60°, etc.). As described above, the tip of the manipulating region may be rounded or pointed.

Figure 2L:
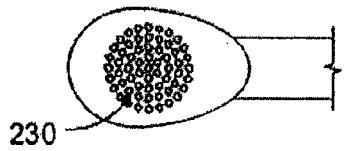

The manipulating region may also be configured to sieve material. For example a manipulating region may include perforations or passages through the surface (e.g., from the inner to the outer surfaces), so that some material (e.g., fluids) may pass through the manipulating region while other materials are collected, carried or stored by the spatula. In some variations, the manipulating regions size-sorts materials using sieves of different passage sizes. FIG. 2L shows an example of a manipulating region (here shown as a shovel region) having passages 230 therethrough. The size of the passage may allow some materials to pass, but not other materials. Any appropriate size may be used. Thus, the sieve may be a filter. In some variations, the sieve has passages of varying size. The passages may be "holes" that are round, or any appropriate shape, including slits.

Figure 2M:
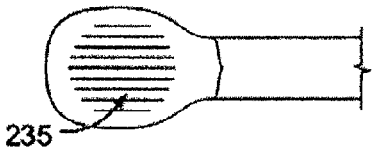

One or more surfaces of a manipulating region (or part of a manipulating region) may also comprise a texture. A textured surface may help prevent material from sliding off of a manipulating region, or may help guide or partition the material that is being held or transported on a surface of the manipulating region. For example, a manipulating region may include channels extending along the manipulating region. FIG. 2M shows an example of a shovel-type manipulating region having textured grooves 235. In some variations, the grooves may provide channels guiding the material into the cavity of the stalk region, where it may be stored, collected or transported.

Figure 2N:
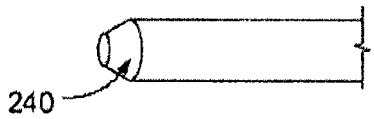

A manipulating region may also be configured to "core" a material such as an agar plate or a tissue. FIG. 2N shows a manipulating region configured as a punch or corer. The corer end comprises an outer surface 240 that is angled with respect to the stalk region. Any appropriate angle (e.g., 30°, 45°, 60°) may be used. This surface may also comprise openings or passages that may aid in removal of cores collected by the corer.

Generally, the manipulating region may be configured to have an inner or outer surface for collecting, storing or transporting material. Other examples of manipulating regions include tweezers, pouches, whisks, and the like. In some variations, the manipulating region may comprise any shape having an open surface (e.g., not part of the cavity of the stalk region) for collecting, storing or transporting a material.

Figure 2P:
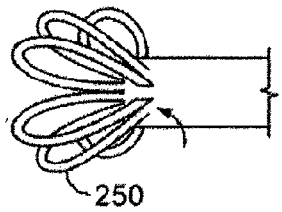
Figure 2Q:
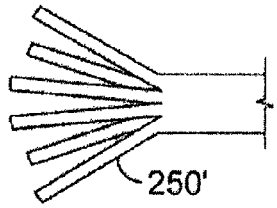

FIGS. 2P and 2Q show manipulating regions that are configured as whisks. For example, in FIG. 2P, the manipulating region comprises surfaces (forming arms) that are folded back and secured at both ends to form loops 250 so that the manipulating region resembles a conventional whisk. The manipulating region shown in FIG. 2Q has arms 250' forming a whisk that are not looped, but are instead unconnected at one end. A whisk region may be used, for example, to collect fibrous, viscous, or mucoid material (e.g. mucus, algae, DNA, etc.).

The manipulating region may also comprise a grasping region. For example the whisk manipulating region shown in FIG. 2Q may be used as a grasping region by using the arms of the manipulating region to grasp a material (or materials). In some variations, the arms of the manipulating region are hooked or bent, so that they may more readily grasp or adhere to a material. For example, the arms of the manipulating region shown in FIG. 2Q may be bent inwards (towards the central long axis of the manipulating region). Pressing the manipulating region against a material allows the material to be grasped by the manipulating region. Grasping regions such as this may be used to support objects or materials weighing less than 1 g, less than 10 g, less than 25 g, less than 50 g, less than 75 g, etc.

In some variations, a region (e.g., the end) of the spatula may be configured to mount to another tool, such as a rotary device. For example, one end of the spatula may be adapted to mount to another tool by including a reinforced attachment region that may include a fastening means (e.g., threads, latches, etc.). A spatula may thereby be attached to any appropriate tool. For example, the spatula may be mounted or connected to a tool for pipetting, stirring, rotating, moving, mixing, etc., with the spatula.

Figure 2R:
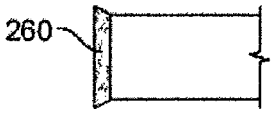
Figure 2S:
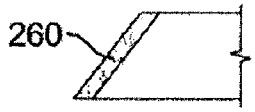

The manipulating region may also be formed by sealing (e.g., heat sealing) the end of the spatula to form a surface for manipulating material 260, as shown in FIGS. 2R and 2S. In FIGS. 2R and 2S, the manipulating region does not have an opening at the end of the spatula (although there may be an opening into a hollow portion of the stalk region that is located closer to the stalk region). Instead, the end is pinched together to form a surface for manipulation of material (e.g., a scraper) 260. The sealed end of the manipulating region may be stronger and/or more rigid than variations of the spatula that are unsealed (or unreinforced). In some variations, the sealed end at least partially closes off the hollow portion of the stalk region.

Figure 2T:
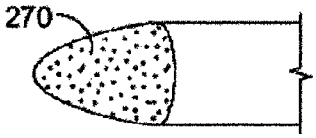

The manipulating region may also be closed off without pinching (e.g., without forming a flat surface). For example, FIG. 2T shows a manipulating region comprising a grinder 270 formed by closing of the distal end of the manipulating region resulting in a rounded or blunt end. In some variations, the outer surface of the manipulating region comprises a texture to assist in manipulating the material. In FIG. 2T, the end of the manipulator region 270 is stippled to indicate a texture thereon. As described herein, any appropriate texture may be used, including pitted, pocketed, jagged, pebbled, etc. Of course, any portion of any variation of the manipulating regions described herein may comprise a textured surface.

Figure 2U:
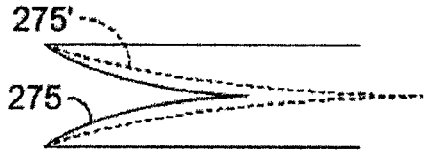

In some variations, the manipulating region, or portions of the manipulating region, may be movable to manipulate material. For example, FIG. 2U shows a manipulating region configured as a tweezers, having arms 275, 275' that may be moved relative to each other to grasp or otherwise manipulate material. In some variations, the arms are relatively rigid, but may be moved by squeezing a portion of the spatula above the arms, thereby opening the arms of the tweezers; releasing the shaft portion allows the arms to close relative to each other. In some variations, the manipulating region may comprise arms that are hinged, or otherwise movably connected to the manipulating (or stalk) region so that they can be opened or closed.

Figure 2V:
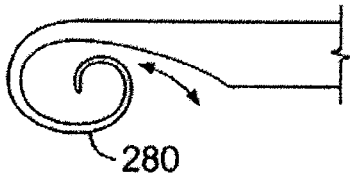
Figure 2W:
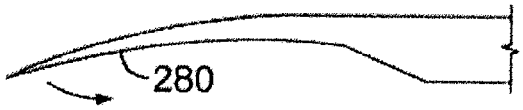

The manipulating region may also be extendable. Thus, a portion (e.g., the very end) of the manipulating region may be extendable and/or retractable with respect to other portions of the manipulating region, or with respect to the stalk region. For example, the tip of the manipulating region may be protected (including keeping it sterile) by retracting it until the user wishes to contact a material. The user may then cause the end to extend (or retract) by acting on the manipulating region. FIGS. 2V and 2W show one example of a retractable/extendable manipulating region. In FIG. 2V, the end of the manipulating region 280 is curled up in the retracted state. In some variations, the inside of the manipulating region is continuous with the hollow portion of the stalk region, and the stalk region is closed at both ends, so that the hollow region is sealed. Thus, squeezing the spatula (e.g., the stalk region) to compress the hollow region increases the pressure within the hollow region, and may force the end of the manipulating region 280 to uncurl, as shown in FIG. 2W. In some variations, the manipulating region may be extended or retracted in some other way, including moving a piston member within the spatula (e.g., a plunger within the hollow portion of the manipulating member and/or stalk), or pulling a wire or string or other material that transverses the hollow portion of the stalk. In some variations of the spatula, a manipulating end may be extended by applying external pressure. For example, a manipulation region that is curled may extend (uncurl) when pressed and/or dragged against a surface. Release of the pressure allows the end to curl back up, thus protecting the sample.

Figure 2X:
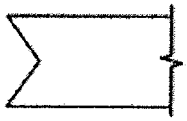
Figure 2Y:
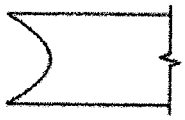

FIGS. 2X and 2Y show variations of the manipulating region that have surfaces formed by cutting or removing triangular (as in FIG. 2X) or elliptical (as in FIG. 2Y) portions. Manipulating regions with such cuts may also be used as punches or corers, as described above, or to otherwise manipulate material.

Figure 3A:
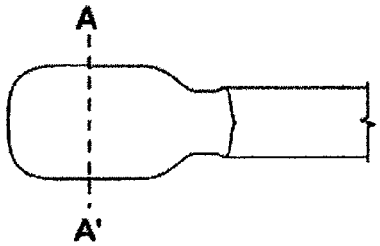
FIG. 3A shows a top view of a manipulating region that may be part of a laboratory spatula.
Figure 3B:
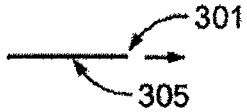
FIGS. 3B to 3D show other variations of cross-sectional profiles through a laboratory spatula as shown in FIG. 3A.
Figure 3C:
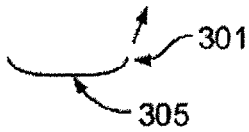
Figure 3D:
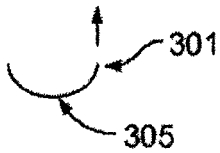

The manipulating region may also have any appropriate curvature for collecting, storing and/or transporting a material. For example, the manipulating region may have edges that are flat or curved upward (to form a cavity or channel) along the inner surface. FIGS. 3B to 3D illustrate different curvatures of a manipulating region in at least one cross-sectional direction. FIG. 3A shows a top view of a manipulating region configured as a shovel region, having a width that is wider than the width of the stalk region, as previously described. Line A-A' sections the manipulating region along this width, and FIGS. 3B to 3D show possible cross-sections of the manipulating region through line A-A' of FIG. 3A. In general, the shovel region may comprise a cross-sectional shape that is flat, or that curves. Curves may or may not be symmetrical (e.g. one side of the manipulating region may curve up, while the other side remains flat, one side may curve up while the other curves down, one side may curve down while the other side remains flat, etc.). The shovel region may be curved inward, so that the inner surface forms a concave region, or the shuttle region may be curved downward, so that the outer surface forms a concave region (not shown). In FIG. 3B, the manipulating region has a flat cross-section. In FIGS. 3C and 3D the manipulating regions are curved towards the inner surface, forming a concave region that is open at one end to a hollow portion of the stalk region, as seen in FIG. 3A. Any appropriate amount of curvature may be used. For example, the edges 301 of the manipulating region may be oriented between (and inclusive of) 0° and 180° relative to the central region 305 of the manipulating region. In some variations, the edges of the manipulating region may include more than one angle (e.g., bend) or a spacer, to separate the edge of the manipulating region from other portions of the manipulating region. In FIG. 3C, the edges are oriented approximately 45° relative to the central region 305, and in FIG. 3D, the edges are oriented approximately 90° relative to the central region 305. In some variations, most of the shovel region or scoop region is flat, and only the edges of the manipulating region (or a region of the edges of the manipulating region) are curved.

As described above, the open surfaces of the manipulating regions of a spatula with more than one manipulating region do not have to lie in the same plane. For example, the open surfaces of a spatula having a shovel region and a scoop region may lie in different planes, or may be oriented differently.

The manipulating regions may be directly connected to the stalk region, or they may be connected via a junction (e.g., a fixed or moveable connecting junction) that may position the manipulating region relative to the stalk region.

Connecting Junction

A connecting junction links the manipulating region to the stalk region, and may be continuous with the stalk region and the manipulating region. In some variations, the laboratory spatula does not include a connecting junction. In some variations, the laboratory spatula includes a connecting junction configured as a neck. For example, the connecting junction may include a neck that positions the manipulating region so that a surface of the manipulating region is in a different plane than (i.e., is not aligned with) the long axis of the stalk region. For example, a manipulating region may be attached to a stalk region so that the manipulating region is at an angle relative to the long axis of the stalk region. Thus, a connecting junction may include a bend and may connect the manipulating region to the stalk region.

The connection junction may have any appropriate shape or size. In some variations, the junction between the stalk region and the manipulating region may have the same diameter as the stalk region. In some variations, the connecting junction may have a smaller diameter than the stalk region.

The connecting junction may position the manipulating region in any appropriate orientation with respect to the stalk region. For example, the manipulating region may be positioned so that the plane of the manipulating region (i.e., the plane formed by the inner surface) is centered with the midline of the stalk region (i.e., the long axis of the stalk region). In some variations, the plane of the manipulating region is parallel to the midline of the stalk region, but is offset from the axis (e.g., the manipulating region is "above" or "below" the long axis of the stalk region).

Returning now to FIGS. 2A, a connecting junction 250 connects the manipulating region with the stalk region. FIG. 2B shows another manipulating region that is linked to a stalk region by a connecting junction 250. FIG. 2C shows a manipulating region that is connected to the stalk region without a separate connecting junction. Thus, a laboratory spatula may not have a discrete connecting junction.

The connecting junction may also be removable, or may allow the removal of the manipulating region (or a part of the manipulating region) from the stalk region. For example, the connecting junction may be perforated so that the manipulating region can be torn or otherwise separated from the stalk region. In some variations, the connecting junction is flexible or bendable. For example, the connecting junction may be an accordion-like shape, allowing movement.

Figure 3G:
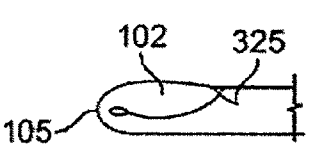
FIGS. 3E to 3G show a side view of a manipulating region that may be closed over an opening into a hollow portion of the spatula.
Figure 3F:
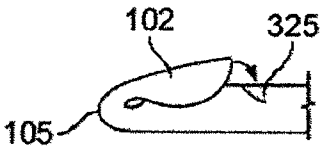
Figure 3E:
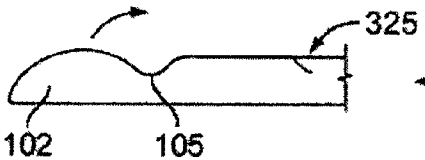

As described above, either or both the manipulating region and the connecting junction may be flexible or movable. In some variations, the manipulating region may be moved so that it restricts (or completely closes off) the entrance into the hollow portion of the stalk region or a portion of the manipulating region. In some variations, the manipulating region (and/or the connecting junction) may be secured either within a hollow portion of the spatula, or on the outside of a hollow portion of the spatula, so that the hollow portion of the spatula is held in a closed configuration. FIGS. 3E-3G illustrate one variation of a manipulating region that closes over the hollow end of a spatula. FIG. 3E shows a shovel-type manipulating region of a spatula similar to the spatula shown in FIG. 1A-1C. The shovel region 102 includes a connection junction 105 that is made of a flexible material (although the entire spatula may be made of the same material), so that the shovel region may be bent over to enclose the opening into a hollow portion of the spatula, as shown in FIG. 3F. The spatula may also include an anchoring region 325 to which the manipulating region can be attached, thereby securing the manipulating region in a closed position. In FIGS. 3E to 3G, the anchoring region is a cut or slot 325 formed in the side of the stalk region into which a portion (e.g., the tip) of the manipulating region can fit.

Figure 3J:
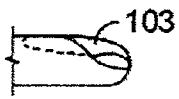
FIGS. 3H to 3J show another variation of a manipulating region that may close off an opening into a hollow portion of the spatula.
Figure 3I:
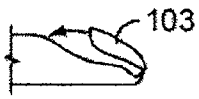
Figure 3H:
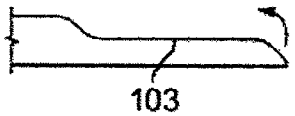

FIGS. 3H to 3J illustrate another variation of a spatula having a hollow portion that can be closed off, at least partially, by bending the manipulating region. In these figures, the manipulating region 103 is configured as a scoop-type manipulating region similar to that shown in the spatula in FIG. 1. This scoop region does not include a connecting junction. Instead, the scoop region is bent approximately 180 degrees, as shown in FIG. 3I, closing off the opening into a hollow portion of the spatula. The manipulating region is secured in a closed configuration by sliding it into the opening of the hollow region, as shown in FIG. 3J. Thus, material stored in within the hollow portion of the spatula may be held within the spatula using the manipulating region to block off an opening into the hollow portion. Of course, the hollow portion of the spatula may also be closed off without using a manipulating region, as described. For example, the opening into the spatula may be sealed (e.g., heat sealed), clamped, stapled, taped, or otherwise closed off, as described above. In some variations, the spatula comprises multiple compartments. For example, the spatula may have multiple compartments that arc formed by closing or sealing off portions of the spatula.

Other variations of the spatula are also possible in addition to those described above. Furthermore, many of the variations described may be combined in full or in part, to form other variations. For example, a spatula may be configured as a spreader (e.g., a cell spreader). Thus, the spatula may apply cells (e.g., bacteria, yeast, etc.) to a media plate, and may be formed from a stalk region as described above with a sealed end having a surface for applying cells. A spatula with a bent stalk region (as shown in FIG. 1H) may be particularly useful as a cell spreader.

Spatula Variations

As described above, a laboratory spatula may comprise any combination of the features described herein. In particular, the laboratory spatula may comprise any number of manipulating regions and a stalk region. The spatula (the manipulating region(s) and stalk region) may be any appropriate size or sizes.

a. Sizes of Spatulas

In general, the laboratory spatula may have a final length and width that is compatible with using the spatula to collect, transport and move material. For example, the spatula may be manually manipulated by a user (e.g., handheld), or automatically (e.g., robotically). Thus, the spatula may be of any size appropriate for manipulation by the user. The dimensions of the spatula may also be correlated to the amount or type of material to be collected, transported or stored by the spatula. For example a spatula may be considered "small," "medium," or "large" based on the dimensions, which may be correlated to the amount, volume or size of material that may be collected, transported or stored using the laboratory spatula. The "small," "medium," or "large" terms may refer to the capacity of the spatula, or the capacity of any region of the spatula.

In general, the spatula may be considered to have a length and a width. It should be understood that a laboratory spatula may have an irregular shape, thus the terms "length" and "width" may refer to the average length and width, the maximum (or minimum) length and width, or a mean length and width. Furthermore, the length and width of the spatula may change in some variations.

A laboratory spatula can be of any appropriate length. For example, the spatula can have a length of between about 20 mm and 400 mm. The laboratory spatula can also have any appropriate width or diameter. For example, the stalk region can have a diameter between about 1 mm and 30 mm. As previously described, the manipulating region of the spatula may comprise diameter that is greater than the diameter of the stalk region (e.g., between about 1 mm and 95 mm), or less than the diameter of the stalk region (e.g., less than about 30 mm). The laboratory spatula may be divided up into a range of sizes that may have additional properties or may be correlated to particular uses. For example, the spatula may comprise micro (e.g., "small"), regular ("medium") or macro ("large") sizes.

a. Micro Spatula

Small (or micro) laboratory spatulas may be used to collect, transfer or store small amounts of materials, particularly when those materials are scarce, rare, or expensive, because the small size of the spatula (especially the manipulating region) may prevent excess material from being retained on the surface of the manipulating region or other regions of the spatula. Thus, as described below, the micro spatula may comprise an anti-sticking or an anti-static material that reduces the attraction or interaction between the surface of the spatula and a material begin collected, transferred or stored by the spatula. In some variations, the spatula may be treated so that a surface of the spatula (or the material from which the spatula is made) has an increased attraction or interaction with a material (e.g., the surface may be made "sticky"). As previously mentioned, any of the spatula variations described herein (e.g. for the micro spatulas) may be included in any other variations of the spatula.

The micro sized spatula may include manipulating regions at both ends of the stalk region. For example, the micro spatula may include a scoop region at one end of the stalk, and a shovel region at the other end of the stalk. In one variation, the micro spatula is a hollow, thin-walled, disposable spatula with a stalk region and at least one manipulating region, wherein at least a portion of the spatula is comprises an anti-static agent, such as fatty acid esters, ethoxylated amines, quaternary ammonium compounds, alkylsulfonates, and alkylphosphates and are sold under a variety of brand names such as Atmer™ AS 290G, Baerostat 318 S, Irgastat® P 18 (CIBA Specialty Chemicals, Switzerland), Irgastat® P 22 (CIBA Specialty Chemicals, Switzerland), Lankrostat 0-600 (Akcros Chemicals, United Kingdom), CESA®-stat PPA-TEE 17690 (Clariant, Winchester Va.), ALA Ethylan L-3, Ampacet 100323 (Amapcet, Tarrytown, N.Y.), Larostat 264 A anhydrous (BASF Corporation, Mount Olive, N.J.), Plasadd PE8811 (Cabot Corp., Boston Mass.), Chemstat 1066-60DC, Masterad Antistatic AD-100L, Dehydat 10 PE 40 (Polycom Huntsman, St. Claire, Mich.), 0129-12, Niax® Antistat AT-21, Kemamide® W-40 (Crompton, Middlebury Conn.), Tegomer® 994 S, Aluminasol 100, Zelec Electroconductive Powder and Bayton. In particular, the material Nourymix® AP 675 (Armostat® 600 in a PP carrier) or Nourymix® AP 475 (Armostat® 400 in a PP carrier) (Akzo Nobel Polymer Chemicals BV, Amersfoort, The Netherlands) may be particularly useful.

The manipulating region may comprise a scoop or a shovel. In some variations, the micro laboratory spatula has two manipulating regions, for example, a manipulating region configured as a scoop region and a manipulating region configured as a shovel region, two scoop regions, or two shovel regions. As described above, a scoop region may comprise an elliptically cut region such that the stalk ends in a rounded area, or the scoop region may comprise a diamond shaped area, having a point at the end of the scoop.

The small size may refer to either the length or the diameter of the laboratory spatula, or both length and diameter. For example, the laboratory spatula may be the same length as the medium (or regular) sized spatula, but the diameter may be smaller. This may allow the spatula to be readily manipulated by a user. In some variations of the micro spatula, both the length and the diameter of the spatula may be smaller. For example, the micro sized spatula may be a "fingertip" spatula that is proportioned so that it may be easily manipulated by the tips of a user's fingers.

Small spatulas may have a length of between about 15 mm and 400 mm and a stalk diameter of between about 2 mm and 5 mm. More preferably, the length is about 140 mm, and the diameter is approximately 3.5 mm.

b. Regular Spatula

Medium (or regular or standard) laboratory spatulas may also be used to collect, transfer or store intermediate amounts of material, including chemical and biological materials. In some variations, the spatula has two manipulating regions, including a scoop end and a shovel end. Medium spatulas may have a length of between about 50 mm and 400 mm, and a stalk diameter of between about 5 mm to 10 mm. More preferably, the length of the medium spatula is about 210 mm, and the diameter of the stalk region of the medium spatula is approximately 7 mm.

In one variation, the regular spatula is a hollow, thin-walled, disposable spatula with a stalk region and two manipulating regions. In some variations, the regular laboratory spatula has a scoop manipulating region and a shovel manipulating region.

c. Macro Spatula

Large (or Macro) spatulas may be used to collect, transfer or store larger amounts of materials, particularly materials that may be difficult to reach with a smaller (or narrower or shorter) spatula. In some variations, the diameter of the larger spatula is larger so that the spatula may have at least one larger manipulating region. In some variations, the length of the large spatula is greater than 300 mm. In some variations, the spatula includes only a first manipulating region. In some variations, the spatula includes a second manipulating region configured as a beveled region, or as a pick region, as described above.

Large spatulas may have a length of between about 210 mm and 450 mm, and a stalk diameter of between about 10 mm and 15 mm. More preferably, the length of the large spatula is about 310 mm, and the diameter of the stalk region of the large spatula is approximately 11.5 mm.

d. Examples

FIGS. 1A-C, 4 and 5 show variations of laboratory spatulas as described herein. In a one variation, shown in FIGS. 4A to 4C, a spatula 100 includes a stalk region 101 having at least a first hollow end and a shovel region 102. The stalk region 101 can have a hollow second end. The stalk region 101 is configured such that a user can hold the spatula 100 without spilling a solid or liquid placed on the shovel region 102 or in the first hollow end.

As previously described, the stalk region 101 can be any shape. In one exemplary embodiment, the cross-section of the stalk region 101 can be a circle, resulting in a stalk having the three dimensional form of a cylinder. In another exemplary embodiment, the cross-section of the stalk region 101 can be a square, giving the stalk region 101 a square three-dimensional form. In another exemplary embodiment, the cross-section of the stalk region 101 can have the shape of any other polygon (e.g. a triangular, rectangular, hexagonal shape, with our without rounded edges). The stalk region 101 can have any diameter. In one embodiment, the stalk region 101 has a diameter of 7 mm. In another exemplary embodiment, the stalk region 101 can have a diameter of 2.5 mm. In another exemplary embodiment, the stalk region 101 has a diameter of between 1.0 mm and 10 mm. In another exemplary embodiment, the stalk region 101 has a diameter of between 10 mm and 40 mm. In some variations, the shape and/or diameter of the stalk region of the spatula may change over the length of the spatula. Thus, the spatula may comprise different cross-sections (e.g., round, square, etc.), or different cross-sectional areas.

The stalk region 101 can be completely hollow. As described, it should be understood that the hollow stalk region 101 allows the spatula to be used as a pipette to move quantities of liquids held therein. In addition, the stalk region 101 can have one or more calibration marks 104 to allow the spatula 100 to measure or estimate quantities of a solid or liquid contained therein. The calibration marks 104 can be for any measure, such as volumes. Calibration marks 104 may be on a portion of the stalk region 101, or may extend around the entire diameter of the stalk region 101. The calibration marks can be arranged in any manner that allows the quantity of a solid or liquid to be measured or estimated. The calibration marks 104 can be made by any method, including but not limited to, printing, screen printing/silk screening, hand painting, lithography (off-set), hot stamping, heat transfer, embossing, debossing, etching, decal, thermography, foil stamping, engraving, laser printing, laser marking/engraving and in-mold decorating. Other methods of making the marks include making the marks directly in the spatula material.

The shovel region 102 can include calibration marks configured to allow measurement or estimation of quantities of a solid or liquid. The calibration marks can be for any quantity, such as a volume. The calibration marks can be arranged in any manner that allows the quantity of a solid or liquid to be measured or estimated. By way of example and not limitation, calibration marks can be placed at any point on or on any surface of the shovel region 102 (including deforming the surface of the spatula to form the calibration marks), on the underside of shovel region 102, or surrounding the entirety of shovel region 102. In another embodiment, the calibration marks may be linear gradations on the shovel region 102, or can be concentric shapes, such as circles or ovals. The calibration marks can be made by any appropriate method.

In another embodiment, a plurality of hollow spatulas can be attached to a single multiple pipette holder or pipette aid. This allows the plurality of spatulas to dispense liquid into a plurality of locations simultaneously (e.g., dispensing liquid to a plurality of wells in a micro titer plate simultaneously). For example, spatulas may be configured to be used by a liquid handling robot or other automated device.

Figure 4A:
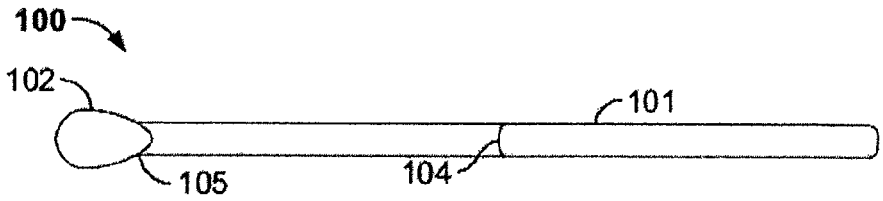
FIG. 4A is a top view of a representative single-ended spatula 100 having a stalk region 101 terminating in a shovel region 102.
Figure 4B:
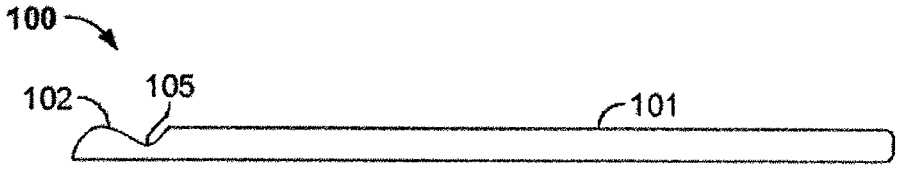
FIG. 4B is a side view of the spatula 100 in FIG. 4A.
Figure 4C:
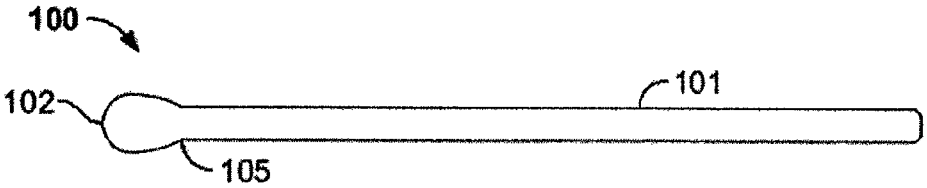
FIG. 4C is a bottom view of the spatula 100 in FIG. 4A.

With reference to FIG. 4B, the shovel region 102 can be continuous with the stalk region 101. In the present embodiment, the shovel region has a larger surface area than the stalk region 101. In other embodiments, the shovel region can be of any size relative to the stalk region 101. Further, the junction between the stalk region 101 and the shovel region 102 can have the same diameter as the stalk region 101. In other embodiments, the shovel region 102 can be thinner than the diameter of the stalk region 101 at the place 105 (e.g., connecting junction) where it adjoins the stalk region 101, or can be wider than the stalk region 101. The shovel region can be of any size or shape. In one exemplary embodiment, the shovel region has a diameter of 20 mm, with a working surface having a linear width of 17 mm.

The dimensions of the manipulating regions of the spatula, particularly the open surface of a manipulating region, may depend upon the size of the spatula (particularly the diameter of the spatula) and upon the shape of the manipulating region. For example, in one variation of the macro spatula, the shovel region is 40 mm from the end of the stalk region to the tip of the manipulating region, and 37 mm from the connecting junction to the tip of the manipulating region, and the shovel region is 30 mm wide (when flattened). The spread of this shovel region (e.g., the width at the widest point of the sides of the shovel) can vary between 20 mm and 26 mm with 22-23 mm being ideal. In one variation of a standard (regular) spatula, a shovel region is 26 mm from the end of the stalk region to the tip of the manipulating region, 22 mm from the narrow connecting junction to the tip of the manipulating region, and the width of the shovel region when flattened is 19 min. The spread of the shovel region at the widest point can vary between 13 mm and 17 mm with 14-16 mm being ideal. In on variation of the micro (small) spatula a scoop region that is in the form of diamond with curved sides is 13.5 mm from the end of the stalk region to the tip or point of the manipulating region and 3.5 mm wide.

Figure 5A:
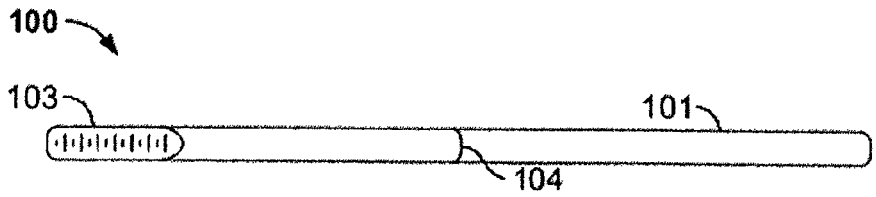
FIG. 5A is a top view of a representative spatula 100 having a stalk region 101 and terminating in a scoop region 103.

In a further embodiment, with reference to FIG. 5A, the spatula 100 includes a stalk region 101 having a hollow first end and a scoop region 103. The stalk region can have a hollow second end. The stalk region 101 is configured such that a user can hold the spatula 100 without spilling a solid or liquid placed on the scoop region 103 or in the first hollow end. The stalk region 101 can be any shape.

The stalk region 101 can be completely hollow. As in the previous embodiment, it should be understood that the hollow stalk region 101 allows the spatula to be used as a pipette to move quantities of liquids held therein. In addition, the stalk region 101 can have one or more calibration marks 104 to allow the spatula 100 to measure or estimate quantities of a solid or liquid contained therein.

Figure 5B:
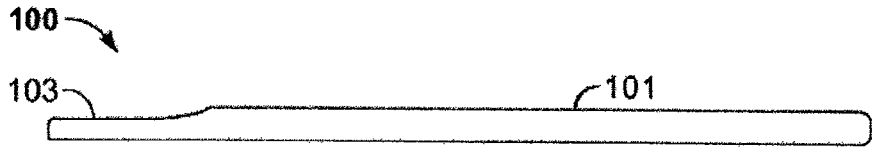
FIG. 5B is a side view of the spatula 100 in FIG. 5A.

With reference to FIG. 5B, the scoop region 103 in the present embodiment can be straight, curved, beveled, or have angles. In another embodiment, the narrow region can be straight. The shape of the scoop region 103 can be configured to allow effective measurement of a solid, such as a powder.

Figure 5C:
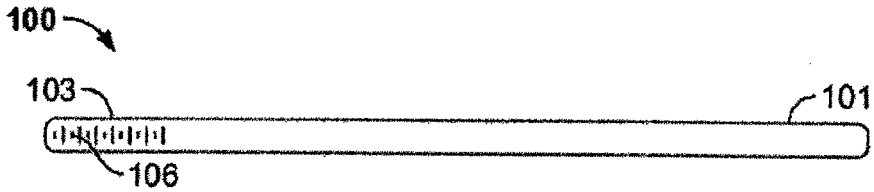
FIG. 5C is a bottom view of the spatula 100 in FIG. 5A, further showing the printed calibration marks 106.

With reference to FIG. 5C, the scoop region 103 in the present embodiment can include calibration marks 106, as previously described. The calibration marks 106 can be arranged to allow measurement or estimation of quantities of a solid or liquid. The calibration marks 106 can be for any quantity, such as a volume. The calibration marks can be arranged in any manner that allows the quantity of a solid or liquid to be measured or estimated. By way of example and not limitation, calibration marks 106 can be placed at any point on or on any surface of the scoop region 103, on the underside of scoop region 103, or surrounding the entirety of scoop region 103. Calibration marks 106 may be at a portion of the scoop region 103, or may extend around the entire diameter of the scoop region 103. The calibration marks 106 can be made by any method, including those described above.

Returning to FIG. 1, FIGS. 1A to 1C show another example of a spatula 100 configured such that a user can hold the spatula 100 to use the shovel region 102 or scoop region 103. It should be understood that the stalk region 101 having a hollow first end and a hollow second end allows the spatula 100 to be used to place quantities of gases, liquids or solids inside the stalk portion. In a further embodiment, the stalk region 101 is completely hollow, as previously described.

A stalk region 101 having a hollow first end and a hollow second end, or a stalk region 101 that is completely hollow, provide advantages over spatulas with stalk regions lacking a hollow first end and a hollow second end, or spatulas lacking a stalk region 101 that is completely hollow. Such stalk regions can give the spatula flexibility, which assists in removing material from difficult-to-reach locations, such as the corners of containers. Spatulas with such stalk regions are lighter than spatulas lacking a hollow first and a hollow second end, have better balance and hand feel, and result in less strain and fatigue to the user. Further, spatulas with such stalk regions are less rigid, allowing for easier disposal in a compactor, scraping material off the sides and bottom of containers, and/or selecting cells or colonies from a group (or groups) of cells or colonies (e.g. tissue culture). Spatulas with such stalk regions facilitate moving other types of materials, such as moving plugs of agar or other semi-rigid materials. As well it can be understood by those skilled in the art, spatulas with such stalk regions can be used as a stir rod capable of both mixing and pipetting liquids simultaneously or sequentially.

In addition, the stalk region 101 can have one or more calibration marks 104, as previously described, for any quantity, such as volumes. One or both manipulating regions can include calibration marks 106 configured to allow measurement or estimation of quantities of a solid or liquid. Further, the cross-section of the stalk region 101 can be any shape.

With reference to FIG. 1B, the shovel region 102 can be continuous with the stalk region 101. In the present embodiment, the shovel region has a larger surface area than the stalk region 101. In other embodiments, the shovel region can be of any size relative to the stalk region 101. Further, the junction between the stalk region 101 and the shovel region 102 can have the same diameter as the stalk region 101. In other embodiments, the shovel region 102 can be thinner than the diameter of the stalk region 101 at the place 105 (e.g., connecting junction) where it joins the stalk region 101, or can be wider than the stalk region 101. The shovel region can be of any size or shape. In one exemplary embodiment, the shovel region, when flattened, has a linear width 30 mm and a linear length of 26 mm.

In the present embodiment, the junction between the stalk region 101 and the shovel region 102 can have any shape or size. The edges can be straight, curved, beveled or cut at angles. In one embodiment, the junction between the stalk region 101 and the shovel region 102 can have the same diameter as the stalk region 101. In other embodiments, the shovel region 102 can be thinner than the diameter of the stalk region 101 at the place 105 where it adjoins the stalk region 101, or can be wider than the stalk region 101.

With further reference to FIG. 1B, the first manipulating region (shown as a scoop region) 103 can be narrower than or the same width as the stalk region 101. The scoop region 103 can be straight, curved, beveled, or have angles. The shape of the scoop region 103 can be configured to allow effective measurement of a solid, such as a powder.

With reference to FIG. 1C, in the present embodiment the scoop region 103 can include calibration marks 106. As described above, the second manipulating region (shown as a shovel region) 102 can include calibration marks configured to allow measurement or estimation of quantities of a solid or liquid, as described above.

Fabricating Laboratory Spatulas

A laboratory spatula as described herein may be fabricated by any appropriate method. In some variations, the laboratory spatula is formed in parts and assembled. In some variations, the laboratory spatula (including the manipulating regions and stalk region) is formed as a single piece. For example, a spatula can be manufactured via extrusion, thermal forming (e.g., thermoforming) or injection molding. Other manufacturing methods include but are not limited to: rotational molding, blow molding, compression molding, reaction injection molding, insert molding, fabrication or other common molding techniques used with thermoplastics, thermosets or other manufacturing materials or combination of materials. In one exemplary embodiment, the spatula is produced by extrusion to make a hollow stalk. In this embodiment, the width of the walls of the stalk can be from 0.01 mm to 12 mm. In another exemplary embodiment, the spatula is produced by thermoforming or injection molding, and the width of the walls of the stalk can be from 0.01 mm to 20 mm. It should be recognized that the each process can be varied to adjust the wall thickness of the spatula.

Fabrication of the spatula may comprise additional steps as well, including forming steps. For example, the stalk region or manipulating regions of the spatula may be shaped, cut, or otherwise formed into an intermediate or final shape either mechanically or manually. In some variations, the final shape of the manipulating region (e.g., shovel or scoop) may be formed with pressure, radiation, heat, stamping, or some combination thereof. Furthermore, the spatula may be treated by the addition of chemicals or other treatments that may provide additional properties. For example, the spatula may be sterilized (e.g., by autoclaving, steam sterilization, dry heat sterilization, gamma irradiation sterilization, chemical disinfectant sterilization, UV sterilization, or any other appropriate means). In some variations, the spatula (or a portion of the spatula) may be treated by the addition of a coating or other layer. Layers may be applied by any appropriate method, including spraying, dipping, submerging, printing, etc.

Materials

The spatula can be produced from any appropriate material. For example, the spatula can be manufactured from any one or combination of thermoplastics or thermosets. Thermoplastics include but are not limited to base resins including styrenics, arylates, olefins, polyamides, polyesters, acetal, high temperature crystalline resins and melt processable flouropolymers. Resins can include, but are not limited to, acrylonitrile-butadiene-styrene (ABS), liquid crystal polymer (LCP), polyacetal (acetal), polyacrylonitrile (PAN) (acrylonitrile), Polyurethane (PU), styrene-acrylonitrile copolymer (SAN), thermoplastic elastomers (TPE), cellulosic, polyamide (PA)(Nylon), polyamide-imide (PAD, polyaryletherketone (PAEK) (Ketone), polycarbonate, polyketone (PK), polyester, polyetheretherketone (PEEK), polyetherimide (PEI), polyethersulfone (PES), polyimide (PI), polyphenylene oxide (PPO), polyphenylene sulfide (PPS), polyphthalamide (PTA), polysulfone (PSU), ethylene vinyl alcohol (E/VAL), fluoroplastics (PTFE) (FEP PFA CTFE ECTFE ETFE), ionomer, polyacrylates (Acrylic), polybutadiene (PBD), polybutylene (PB), polyethylene (PE), polyethylenechlorinates (PEC), polymethylpentene (PMP), polystyrene (PS), polyvinylchloride (PVC), polyvinylidene chloride (PVDC), and/or polypropylene (PP). For example, the spatula may comprise polypropylene homopolymer.

Spatulas made from different materials have different properties. By way of example and not limitation, spatulas made from polystyrene can withstand exposure to diluted acids and bases and temperatures up to between 100° C. and 110° C. Spatulas made from poly(methylmethacrylate) ("PMMA"), an acrylic, can degrade when exposed to acids and bases but can withstand temperatures up to between 85° C. and 100° C. Depending on composition, spatulas made from polypropylene can withstand temperatures up to 170° C.

Thermoset base resins can include but are not limited to acrylics, bismaleimides, cyanate esters, epoxies, vinylesters, phenolics, polyimides, polyesters, urethanes and Ultraviolet ("UV") curables. Such resins include, but are not limited to, polyurethane (PU), epoxy, allyl resin (allyl), melamine formaldehyde (MF), phenol-formaldehyde plastic (PF) polyester, polyimide, and silicone.

Additionally, a biodegradable material (including but not limited to biodegradable plastic or starch), aluminum, tin, paper or waxed paper can be used to manufacture the spatula 100. It should be recognized that the materials, or combination of materials, used to produce the spatula depend on the manufacturing methods and the desired properties of the spatula such as, but not limited to, the presence or absence of static electricity, ability to withstand heat, cold, acids, bases, organics, and exposure to ultraviolet or other radiation.

It should be recognized that base plastic resins can also include materials such as fillers, plasticizers, and stabilizers. For example, polystyrene can be manufactured to resist impact by addition of rubber modifiers or polyester resin reinforced with glass fibers.

a. Material Properties

The spatula may be made compatible with any appropriate laboratory protocol. For example, the spatula may be made DNAase/RNAase free (for use with polynucleotides), magnetic or magnetically inert, anti-stick, anti-static, anticorrosion, pH resistant, sterile, etc., as described further below.

The spatula can be manufactured to be disposable. For example, if the spatula is produced by extrusion, injection molding, or thermal forming, the spatula can be produced at a low cost. Other manufacturing methods include but are not limited to rotational molding, blow molding, continuous extrusion blow molding, compression molding, reaction injection molding, insert molding, fabrication or other common molding techniques used with thermoplastics, thermosets, or other materials used in manufacturing.

In some variations, the spatula may be impregnated, coated, or otherwise treated with a compound that provides the spatula with beneficial properties.

b. Coatings and Treatments

Thus, the spatula can include one or more coatings or layers. The coating can be placed on the surface of one or more regions of the spatula, such as the stalk region or manipulating region. The coating can be placed on the inside or outside of the hollow first end or hollow second end of the stalk, or in a portion of, or the entirety of, a completely hollow stalk.

In one exemplary embodiment, one or more regions of the spatula can be coated with non-stick coatings such as fluoropolymers, silicon, Teflon®, and polytetrafluoroethylene (PTFE) after molding. It should be understood that such a coating can render the coated region of the spatula resistant to sticking of a solid or liquid or render it chemically inert. In another example one or more regions of the spatula can be treated with an external anti-static agent such as, but not limited to, ELEC QN, ELEC AC, LOVING BS-2, or Finastat which can be applied by spraying, wiping or dipping.

Further, one or more internal anti-static agents can be incorporated in the spatula material. Antistatic agents include but are not limited to fatty acid esters, ethoxylated amines, quaternary ammonium compounds, alkylsulfonates, and alkylphosphates and are sold under a variety of brand names such as Atmer™ AS 290G, Baerostat 318 S, Irgastat® P 18 (CIBA Specialty Chemicals, Switzerland), Irgastat® P 22 (CIBA Specialty Chemicals, Switzerland), Lankrostat 0-600 (Akcros Chemicals, United Kingdom), CESA®-stat PPA-TEE 17690 (Clariant, Winchester Va.), ALA Ethylan L-3, Ampacet 100323 (Amapcet, Tarrytown, N.Y.), Larostat 264 A anhydrous (BASF Corporation, Mount Olive, N.J.), Plasadd PE8811 (Cabot Corp., Boston Mass.), Chemstat 106G-60DC, Masterad Antistatic AD-100L, Dehydat 10 PE 40 (Polycom Huntsman, St. Claire, Mich.), 0129-12, Niax® Antistat AT-21, Kemamide® W-40 (Crompton, Middlebury Conn.), Tegomer® 994 S, Aluminasol 100, Zelec Electroconductive Powder and Bayton. In particular, the material Nourymix® AP 675 (Armostat® 600 in a PP carrier) or Nourymix® AP 475 (Armostat® 400 in a PP carrier) (Akzo Nobel Polymer Chemicals BV, Amersfoort, The Netherlands) may be particularly useful. For example, the micro spatula's described above may incorporate an anti-static agent.

The spatula can include a layer or coating allowing the spatula to withstand exposure to high or low temperatures, acids, bases, organics, radiation and/or other environmental conditions. By way of example and not limitation, a Teflon® coating may be applied via spraying. Teflon is normally unaffected by chemical environments. The only chemicals known to affect all Teflon industrial coatings are molten alkali metals and highly reactive fluorinating agents. Teflon is also heat resistant and can withstand temperatures up to about 260° C./500° F.

In another embodiment, one or more regions of the spatula can be treated to become sterile. By way of example and not limitation, the spatula can be heated, washed with antimicrobial solutions, or treated with UV light, ozone, ethylene oxide, and/or radiation (including but not limited to gamma radiation or microwave radiation). In another example, one or more regions of the spatula can be treated to remove pyrogens and/or endotoxins. For example pyrogens and/or endotoxins can be removed by the use of a high-emulsifying cleaner combined with heat, followed by rinsing with pyrogen-free or endotoxin-free water.

In another embodiment, one or more regions of the spatula can be treated to remove Dnases and/or Rnases. For example, DNase can be destroyed by autoclaving a spatula for 15 minutes at 121° C. DNase and Rnase can be removed from a spatula through the use of chemical baths or through the use of commercially available decontamination solutions such as ELIMINase® or NucleasEliminator™. RNase can be removed through the use of commercially available decontamination solutions such as RNaseAway™ and RNaseZap™. The commercial solutions listed do not degrade glass, plastics or stainless steel.

c. Appearance

The spatulas may be marked, colored, or coded in any appropriate fashion. For example, the spatula may be designed to have one or more colors. The one or more colors can be selected to provide contrast with colored powders, solids, or liquids. Further the spatula may be designed to have colored stripes. The color differences or the presence or absence of color stripes may be used to provide a visual indication of the properties of the spatula 100, e.g. non-sterile spatula or sterile spatula. The one or more colors can be any color in the visual spectrum. Alternatively, the one or more colors can be fluorescent. The spatula may also be designed without color, opaque or clear.

The spatula may also include one or more indicators, including color indicators that indicate use or some physical property of the spatula. For example, the spatula may include a thermosensative dye which reacts to indicate temperature (e.g., above/below a certain temperature). In another example, the spatula may include a sterility indicator, or an indicator of exposure to various environments (e.g., a pH indicator).

It will be appreciated that writing can be included at any region of the spatula, as previously described. The writing can include a mark, such as an identifying company mark, trademark, or patent mark. The writing may be added by any means known in the art.

Methods of Using Spatulas

In practice, the spatula may be used to collect, transfer or store any appropriate material, including chemical and biological material. For example, the spatulas described herein may be used with laboratory chemicals (e.g., chemicals, mixtures, solutions, and/or compounds that may be used in medical and scientific research, or treatment). Generally, a user manipulates the spatula by gasping the stalk region of the spatula to control a manipulating region of the spatula. Thus, the spatula may be used as a spatula, a shovel, a scraper, a stirring rod, a policeman, or the like.

In some variations, the spatula comprises two manipulating regions. For example, a first manipulating region may be configured as a scoop, and the second manipulating region may be configured as a shovel. Either end of the spatula may therefore be used to collect, transport or store material. The spatula may be appropriate for laboratory use, food preparation, or for manufacturing uses. For example, the spatula may conform to regulatory standards for food contact applications (e.g., U.S. FDA standards), or commercial manufacturing standards.

The spatula may be used to collect material using the manipulating region. Thus, a user may grasp the stalk region and guide the manipulating region of the spatula toward the material to be collected. In some variations, the manipulating region may be configured to gather material to be collected, for example, by scooping, scraping, tearing, cutting, dividing, or any other appropriate manipulation. The material can contact one of the collecting surfaces (e.g., the inner or outer surfaces) of the manipulating region, so that it can be supported by the surface, and collected.

In some variations, the spatula may be used with additional collection devices. For example, the spatula may be use with another spatula or other manipulator. In another example, the spatula (e.g., the hollow region through the stalk) may be attached to a suction device. In some examples, the spatula may be treated to attract or retain a material to be collected. For example, the spatula may be magnetic, or may include a magnetic material, that may help collect materials that are magnetically permeable (or are themselves magnetic).

Materials may also be transported using the spatula. Once a material has been collected by the spatula, the material may be held on the collecting surface, or within the hollow region of the spatula (such as the stalk region). The spatula may be used to transport material held in or on the spatula. The spatula can be sealed by a plug, by heat, stapled or taped closed. Material may likewise be released from the spatula once it has reached a desired location. In some variations, the spatula may include ways to retain or to hold material (to prevent leakage, spilling, etc.) during transport. For example, the spatula may include a cover (e.g., to cover all or a part of the manipulating region), or a cap to cover a hollow region (e.g., in the stalk). Materials may also be transported by the spatula when the materials are not collected on or in the spatula. For example, the spatula may be used to stir a material (e.g., as a stir rod) or to push a material, or to break up a material.

The spatula may also be used to store material, for either short term (e.g., seconds, minutes, hours) or for long term (days, months, years). For example, material maybe collected by the spatula, and held in the hollow region of the stalk. This region may be capped (e.g., to prevent loss of the material from the hollow region) by blocking the one or more opening into the hollow region (e.g., with plugs, seals, covers, clamps, lids, stoppers, etc.). The spatula, containing the material, may then be stored until the material is needed for later use. In some variations, the spatula may be frozen (including freezing in liquid nitrogen, etc.). In some variations, the spatula may include calibration marks indicating the volume or other characteristic of the material within the spatula. In some variations, the spatula comprises a UV or light-protecting material that prevents photodamage to material stored in the spatula.

(a) Kits

The spatula 100 can be part of a kit. A kit may comprise one or more spatulas as described herein, and directions for using the spatula. Instructions may be written or pictorial, and may be in any language, or may be translated into multiple languages. In some variations, the kit may also comprise packaging for the spatula. The packaging may protect, the spatula, preventing contamination or otherwise maintaining the integrity of the spatula. The packaging may be individual (e.g., each spatula may be individually wrapped), or the packaging may hold multiple spatulas. For example, spatulas may be packaged in a set of 25, 100, 200, 300, 500, 1000, etc. In some variations, instructions or other labels may be printed on the packaging. In some variations, the packaging may include suggested uses, or warnings. For example, the packaging may indicate suggested uses, what material the spatula is made of, the material properties of the spatula (e.g., disposability or how to dispose of the spatula, the acid/base tolerance, autoclavability, shatter resistance, weight, size, shape, chemical tolerance, color, etc.), or the like.

In some variations, a kit comprising a spatula may include a pre-loaded material. For example, a material (including a solution) may be pre-loaded into the spatula as previously described. Thus a kit may include a solution pre-loaded into the spatula. Any appropriate solution or solid may be used (i.e., buffers etc.). For example, a preloaded solution may be dehydrated.

The foregoing described embodiments of the invention are provided as illustrations and descriptions. They are not intended to limit the invention to precise form described. For example, as discussed above, the concepts and principles of the present invention will apply to other laboratory spatulas, scoops, or the like. Furthermore, although the spatula is described as a laboratory spatula, it should be understood that the spatulas described herein may be used for any appropriate purpose, in any appropriate setting, not limited to research or medical laboratory uses.

In particular, it is contemplated that the laboratory spatulas described herein may be implemented equivalently in shape, materials, and/or other reasonable dimensions. Other variations and embodiments are possible in light of above teachings, and it is thus intended that the scope of invention not be limited by this Detailed Description, but rather by Claims following.

We claim:

1. A disposable thermoplastic laboratory spatula for manipulating, collecting, transporting or storing laboratory chemicals or samples, the disposable laboratory spatula comprising:

a cylindrical, hollow stalk region having a first open end and a second open end, a spoon region comprising an extended open surface having a length to width ratio in the range from about 2.5 to 1 to about 2 to 1.5 and configured to collect an amount of laboratory chemical or sample, the extended open surface of the spoon region having round, curved and smooth edges, the spoon region being unitary and continuous with the first open end of the stalk region, where the width of the spoon region exceeds the width of the stalk region; and a second manipulating scoop region comprising an extended open surface having a pointed tip and a length to height ratio in the range from about 10 to 1 to about 30 to 1 and configured to collect an amount of laboratory chemical or sample the scoop region being unitary and continuous with the second open end of the stalk region and with the spoon region.

2. The disposable laboratory spatula of claim 1, further comprising a calibration mark for measuring a quantity of material held by the spatula.

3. The disposable laboratory spatula of claim 1, wherein the stalk region has a calibration mark for measuring a quantity of material contained in the stalk region.

4. The disposable laboratory spatula of claim 1, wherein the spatula is made from polypropylene.

5. The disposable laboratory spatula of claim 1, further comprising an anti-static material.

6. The disposable laboratory spatula of claim 1, wherein the spatula has a length of about 210 mm.

7. The laboratory spatula of claim 1, wherein the extended open surface of the spoon region has a length of about 25 mm and a width in a range from about 12 mm to about 17 mm.

8. The laboratory spatula of claim 7, wherein the extended open surface of the scoop region has a length of about 30 mm and a height of about 3 mm.

9. A method of using a disposable laboratory spatula of claim 1, the method comprising:

grasping the disposable laboratory spatula at the stalk region;

contacting laboratory chemical or sample with the spoon or the scoop region of the disposable laboratory spatula;

inserting the spoon or the scoop region of the disposable laboratory spatula into the laboratory chemical or sample until some of the laboratory chemical or sample is collected by the laboratory spatula;

lifting the disposable laboratory spatula from the laboratory chemical or sample, wherein a desired amount of the laboratory chemical or sample is collected so that a portion of the desired amount held in the spoon or the scoop region of the disposable laboratory spatula;

transporting the disposable laboratory spatula with the desired amount of the laboratory chemical or sample to a receiving surface;

tilting the disposable laboratory spatula to transfer the desired amount of the laboratory chemical or sample to the receiving surface; and disposing of the disposable laboratory spatula.

10. A disposable thermoplastic laboratory spatula for manipulating, collecting, transporting or storing laboratory chemicals or other samples, the spatula comprising:

a cylindrical hollow stalk region having a first open end and a second open end;

a spoon region comprising an extended open surface having a length to width ratio in the range from about 5 to 3 to about 4 to 3 when completely flattened, and configured to collect an amount of laboratory chemical or sample, the extended open surface of the spoon region having round, curved, and smooth edges, the spoon region being unitary and continuous with the first open end of the stalk region, where the width of the spoon region exceeds the width of the stalk region; and an angle cut region having a cut angle in the range from about 25 degrees to 35 degrees and being unitary and continuous with the second open end of the stalk region and with the spoon region.

11. The spatula of claim 10, further comprising an anti-static material.

12. The spatula of claim 10, further comprising an anti-adhesive material.

13. The spatula of claim 10, further comprising one or more calibration marks for measuring a quantity of material held by the spatula.

14. The spatula of claim 1, wherein the stalk region has calibration marks for measuring a quantity of material contained in the stalk region.

15. The spatula of claim 10, wherein the spatula is made of polypropylene.

16. The spatula of claim 10, wherein the extended open surface of the spoon region has a length of about 42 mm and a width of about 30 mm when completely flattened.

17. The spatula of claim 10, wherein the spatula has a length of about 310 mm.

* * * * *